US007660553B2

(12) United States Patent
Kikuchi

(10) Patent No.: US 7,660,553 B2
(45) Date of Patent: Feb. 9, 2010

(54) IMAGE HEATING APPARATUS

(75) Inventor: Nobuhiro Kikuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 11/275,516

(22) Filed: Jan. 11, 2006

(65) Prior Publication Data

US 2006/0165446 A1 Jul. 27, 2006

(30) Foreign Application Priority Data

Jan. 19, 2005 (JP) ..... 2005-011712

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 5,525,775 A 6/1996 Setoriyama et al. ..... 219/216
6,671,488 B2 12/2003 Izawa et al. ..... 399/329
2002/0168202 A1 * 11/2002 Izawa et al. ..... 399/329
2004/0120740 A1 * 6/2004 Uekawa et al. ..... 399/329

FOREIGN PATENT DOCUMENTS

JP 4-44075 2/1992
JP 10-186910 7/1998
JP 2002-323821 11/2002

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

In an image heating apparatus having an endless belt for heating an image T on a recording material P in a nip portion N, nip forming means for forming the nip portion N between itself and the belt, and regulating means for regulating the bias of the belt in the width direction thereof, even when in the rotation shape of the endless belt, there is a portion changing greatly in curvature, the damaging of the end portion of the endless belt resulting from the long-period use of the endless belt is prevented to thereby improve the durability of the belt. The regulating means is characterized by a flat plate-shaped rotary member provided at a predetermined distance from the belt and capable of being driven to rotate by contacting with the end surface of the belt with the bias of the belt.

4 Claims, 9 Drawing Sheets

IMAGE HEATING APPARATUS

BACKGROUND OF THE INVENTION

1. Field of the Invention

This invention relates to an image heating apparatus for heating an image on a recording material. The image heating apparatus can be used, for example, as a fixing apparatus for fixing an unfixed image on a recording material in a copying machine, a printer or the like.

2. Description of Related Art

In an image forming apparatus adopting an electrophotographic image forming process, there has heretofore been provided a fixing apparatus for heat-fixing an unfixed toner image on a recording material.

In recent years, from the viewpoints of quick start and energy saving, there has been put into practical use a fixing apparatus using a belt (see, for example, Japanese Patent Application Laid-open No. H04-44075).

Specifically, this fixing apparatus is of a construction in which a fixing belt is nipped between a ceramic heater and a pressure roller to thereby form a fixing nip, and a recording material is introduced into this fixing nip to thereby fix an unfixed toner image on the recording material.

Such a fixing apparatus using the belt does not require the supply of electric power to the heater on standby, and can be brought into a state in which it is capable of fixing before the recording material arrives at the fixing nip even if the supply of electric power to the heater is effected after the image forming apparatus has received a print signal. Consequently, it is excellent in that the time required for image formation can be shortened and also, consumed electric power can be reduced.

There has also been proposed a fixing apparatus in which a pressure pad is disposed so as to be opposed to a fixing roller with a belt interposed therebetween (see, for example, Japanese Patent Application Laid-open No. H10-186910).

In these fixing apparatuses using a belt, there is the possibility that the belt is biased toward a bus line and the conveyance of the recording material becomes unstable to thereby cause the recording material to be wrinkled.

So, against such a problem, there has been proposed a method of regulating the bias of the belt (see, for example, Japanese Patent Application Laid-open No. 2002-323821).

Specifically, a protective cap made of a resin normally driven to rotate by the frictional contact thereof with the outer peripheral surface of the end portion of the belt is provided so as to cover the end portion of the belt, and the movement of this protective cap made of a resin toward the belt is regulated by a fixed flange.

However, in the case of such a method of regulating the bias of the belt, because of a construction in which the protective cap made of a resin restrains the configuration of the belt, there has been the possibility of a load being applied to the belt to thereby damage the belt.

Also, when an attempt is made to achieve the higher speed of the image forming apparatus, the construction in which the outer peripheral surface of the belt and the protective cap made of a resin frictionally slide with each other has led to the possibility of the belt being damaged with the shaving of the surface layer of the belt.

SUMMARY OF THE INVENTION

It is an object of the present invention to provide an image heating apparatus in which the durability of a belt can be prevented from being reduced.

It is also an object of the present invention to provide an image heating apparatus having:

an endless belt for heating an image on a recording material in a nip portion;

nip forming means for forming the nip portion between itself and the belt; and regulating means for regulating movement of the belt in the width direction thereof, the regulating means having a plate-shaped member rotated by the contact thereof with the end surface of the belt.

DESCRIPTION OF THE PREFERRED EMBODIMENTS

An embodiment of the present invention will hereinafter be described with reference to the drawings. Description will first be made of an image forming apparatus, and then will be made of a fixing apparatus as an image heating apparatus.

EMBODIMENT (1) Image Forming Apparatus

Figure 1:
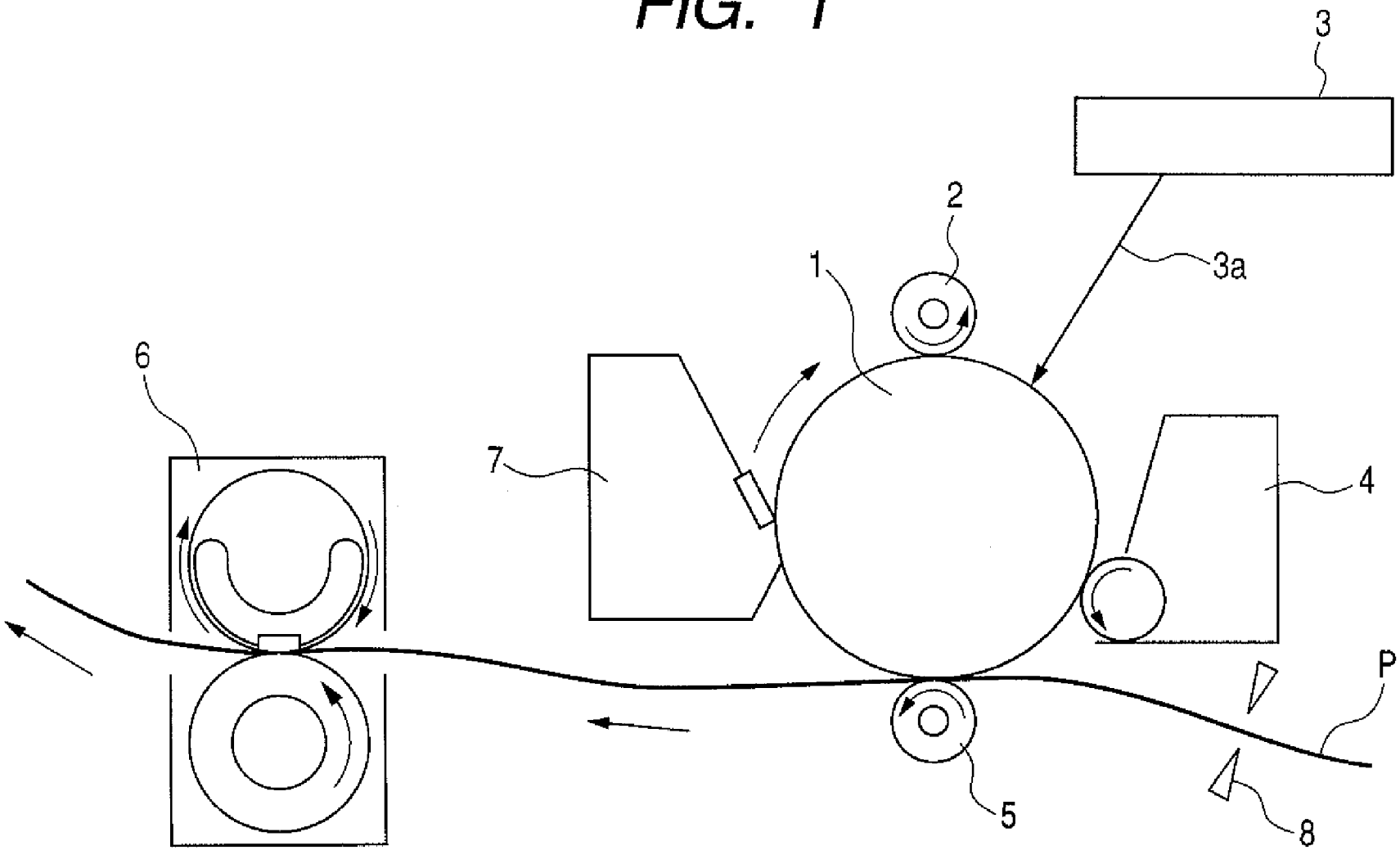
FIG. 1 schematically shows the construction of an image forming apparatus.

FIG. 1 schematically shows the construction of an example of an image forming apparatus. This example of the image forming apparatus is a printer using an electrophotographic printing process.

The reference numeral 1 designates a photosensitive drum as an image bearing member, in which a layer of photosensitive material such as OPC, amorphous Se or amorphous Si is formed on a cylinder-shaped electrically conductive base of aluminum, nickel or the like.

The photosensitive drum 1 is rotatively driven at a predetermined peripheral speed in the clockwise direction of arrow and first, the surface thereof is uniformly charged to a predetermined polarity and predetermined potential by a charging roller 2 as a charging apparatus.

Next, the uniformly charged surface is subjected to scanning exposure 3*a* by a laser beam ON/OFF-controlled in conformity with image information by a laser scanner 3, whereby an electrostatic latent image is formed thereon.

This electrostatic latent image is developed and visualized as a toner image by a developing apparatus 4. As the developing method, use is made of a jumping developing method, a two-component developing method, a FEED developing method or the like, and a combination of image exposure and reversal development is often used.

The visualized toner image is transferred from the photosensitive drum 1 onto a recording material P conveyed at predetermined timing, by a transfer roller 5 as a transferring apparatus.

Here, the leading end of the recording material P is detected and timed by a sensor 8 so that the image-formed position of the toner image on the photosensitive drum 1 and the writing start position of the leading end of the recording material P may coincide with each other. The recording material P conveyed at the predetermined timing is nipped and conveyed between the photosensitive drum 1 and the transfer roller 5, and the toner image on the photosensitive drum 1 is sequentially transferred onto the surface of the recording material P. The recording material P to which the toner image has been transferred is separated from the surface of the photosensitive drum 1 and is conveyed to a fixing apparatus 6 which is an image heating apparatus, and the toner image thereon is heated and fixed as a permanent image.

On the other hand, the surface of the photosensitive drum 1 after the separation of the recording material therefrom has any toner residual thereon removed by a cleaning apparatus 7, and is repetitively used for image formation.

(2) Fixing Apparatus

The fixing apparatus 6 as the image heating apparatus in this example uses a cylindrical metal belt (endless belt) as a heating member. This belt (film) is designed to be rotated by receiving a drive from a pressure roller which will be described later.

In the following description, the width direction of the fixing apparatus 6 or a member constituting the same is a direction parallel to a direction orthogonal to the conveying direction of the recording material in the plane of a recording material conveying path.

Also, with respect to the fixing apparatus 6, the front surface is a surface as it is seen from the entrance side of the recording material, and the back surface is a surface opposite thereto (the exit side of the recording material). The left or right is the left (this side) or the right (inner part side) when the apparatus is seen from the front thereof. The upstream side and the downstream side are the upstream side and the downstream side with respect to the conveying direction of the recording material.

Figure 2:
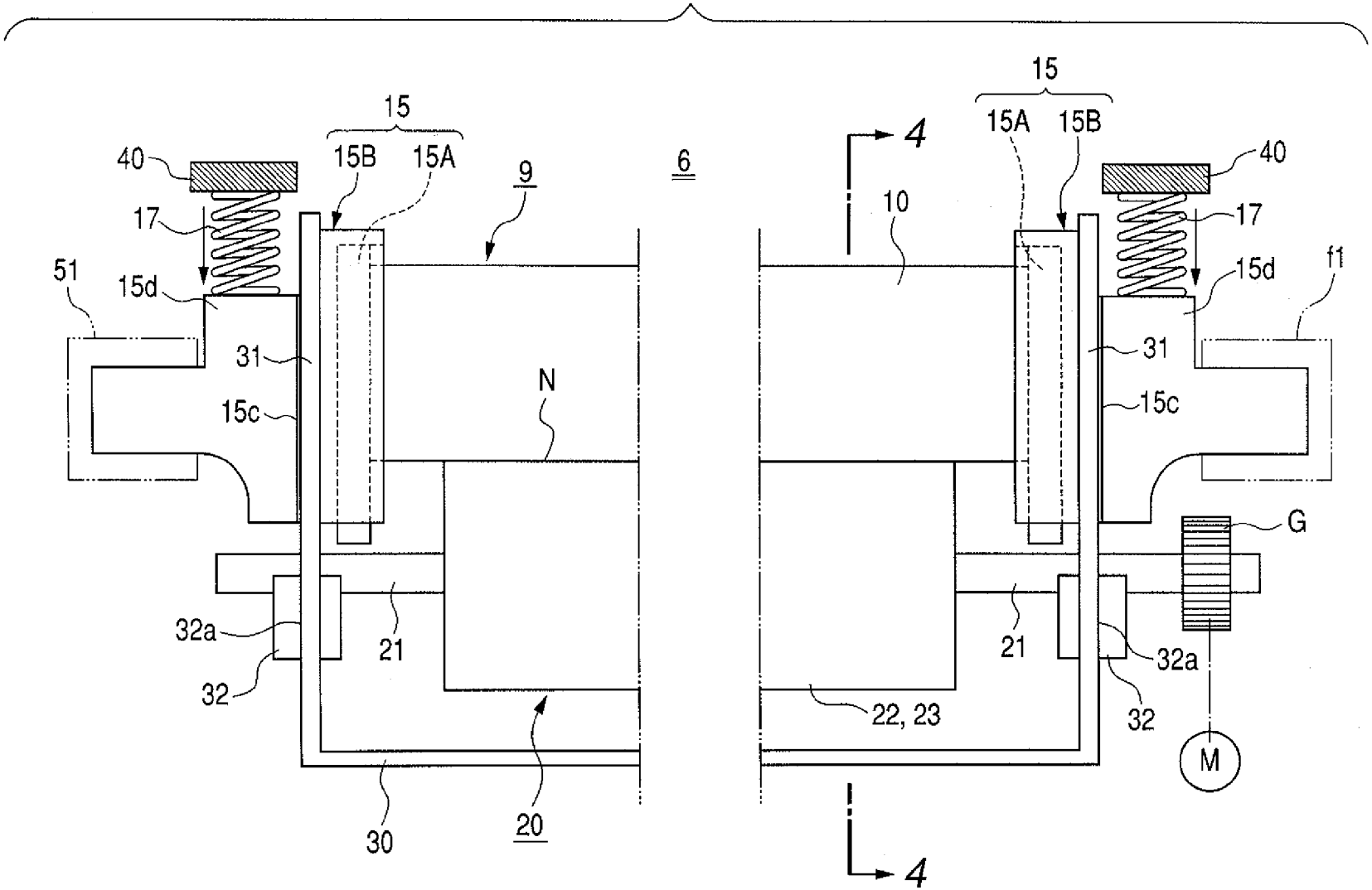
FIG. 2 is a front model view of a fixing apparatus.
Figure 3:
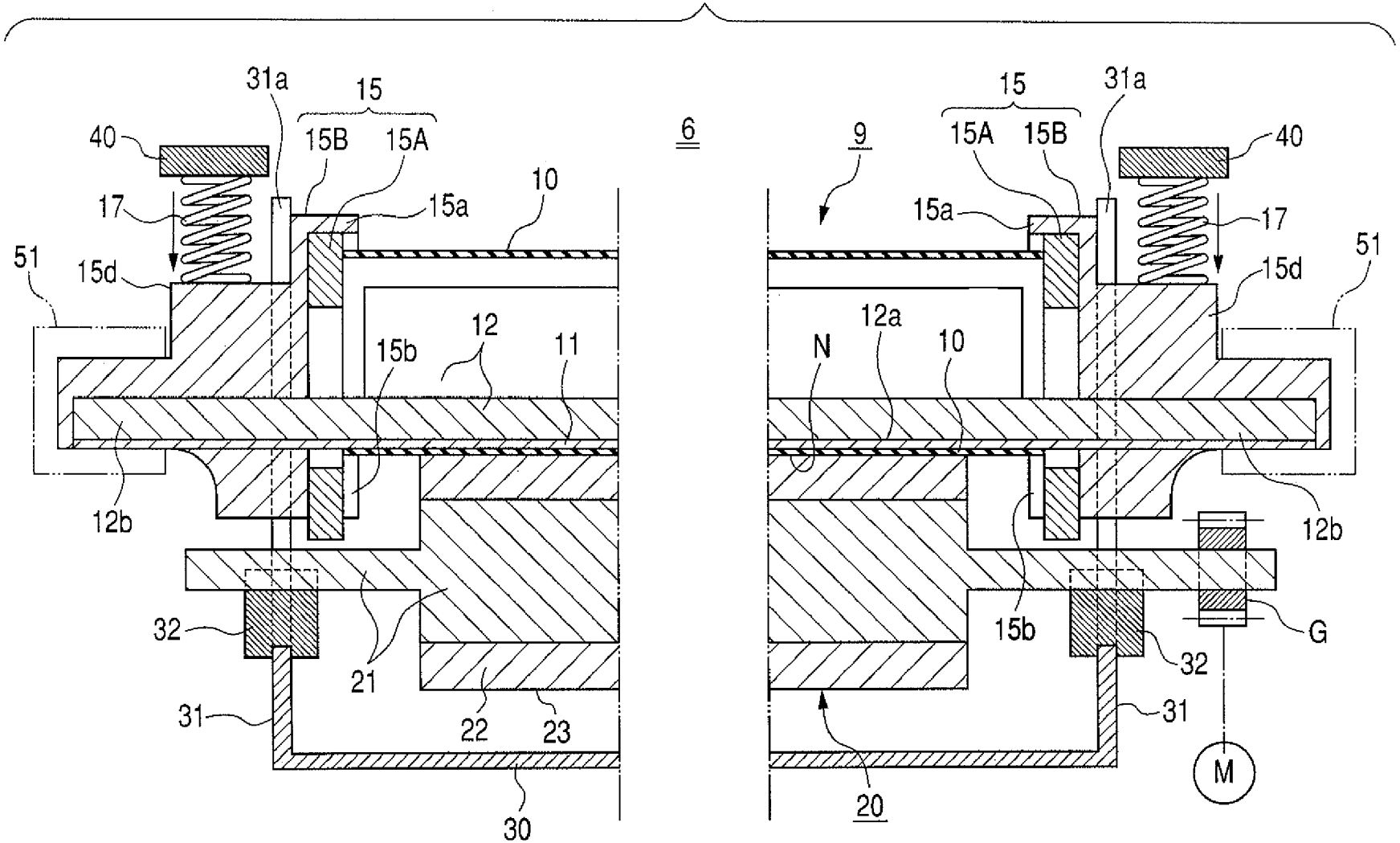
FIG. 3 is a longitudinal sectional front model view of the fixing apparatus.
Figure 4:
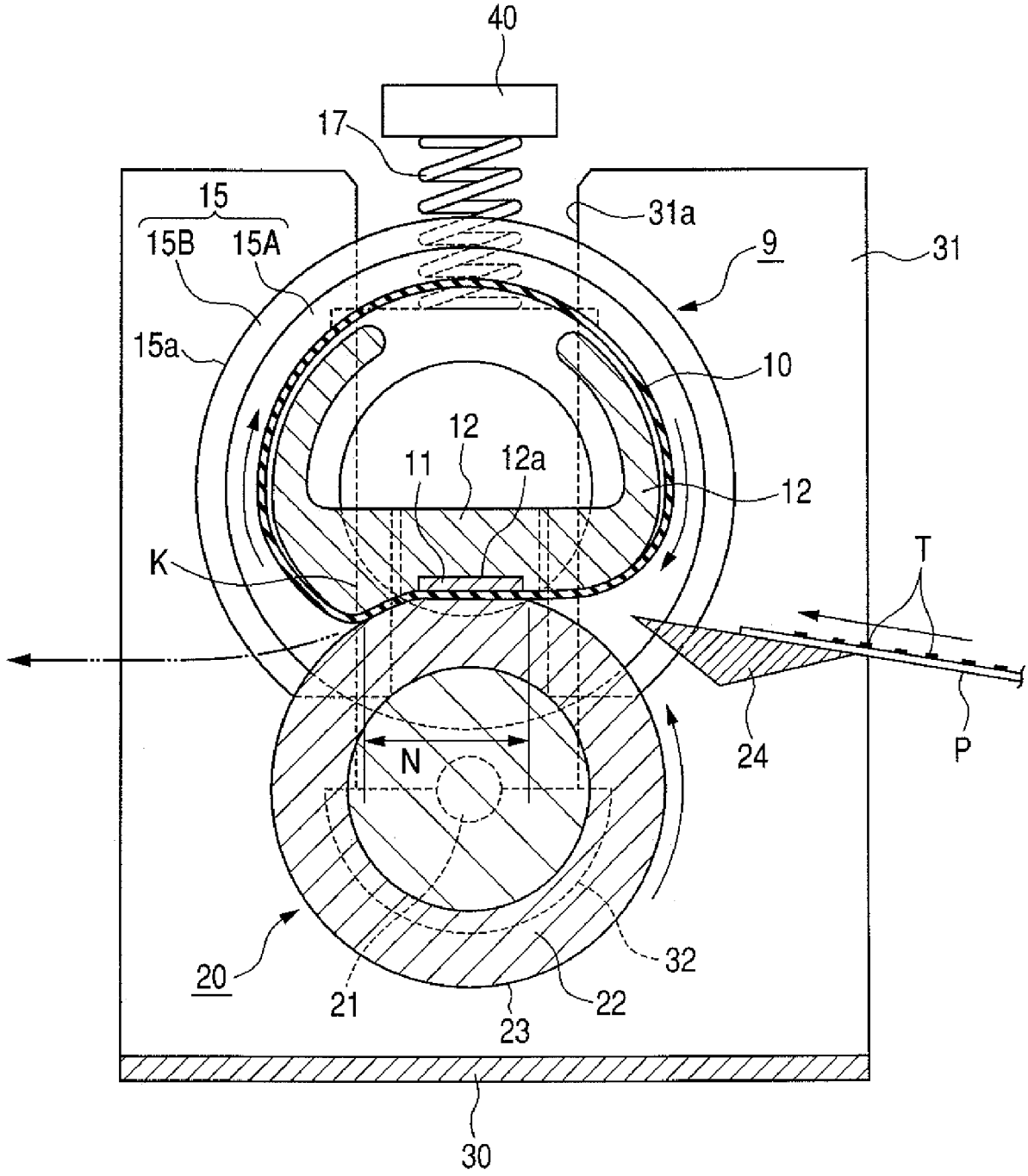
FIG. 4 is an enlarged transverse sectional model view taken along the line 4-4 of FIG. 2.
Figure 5:
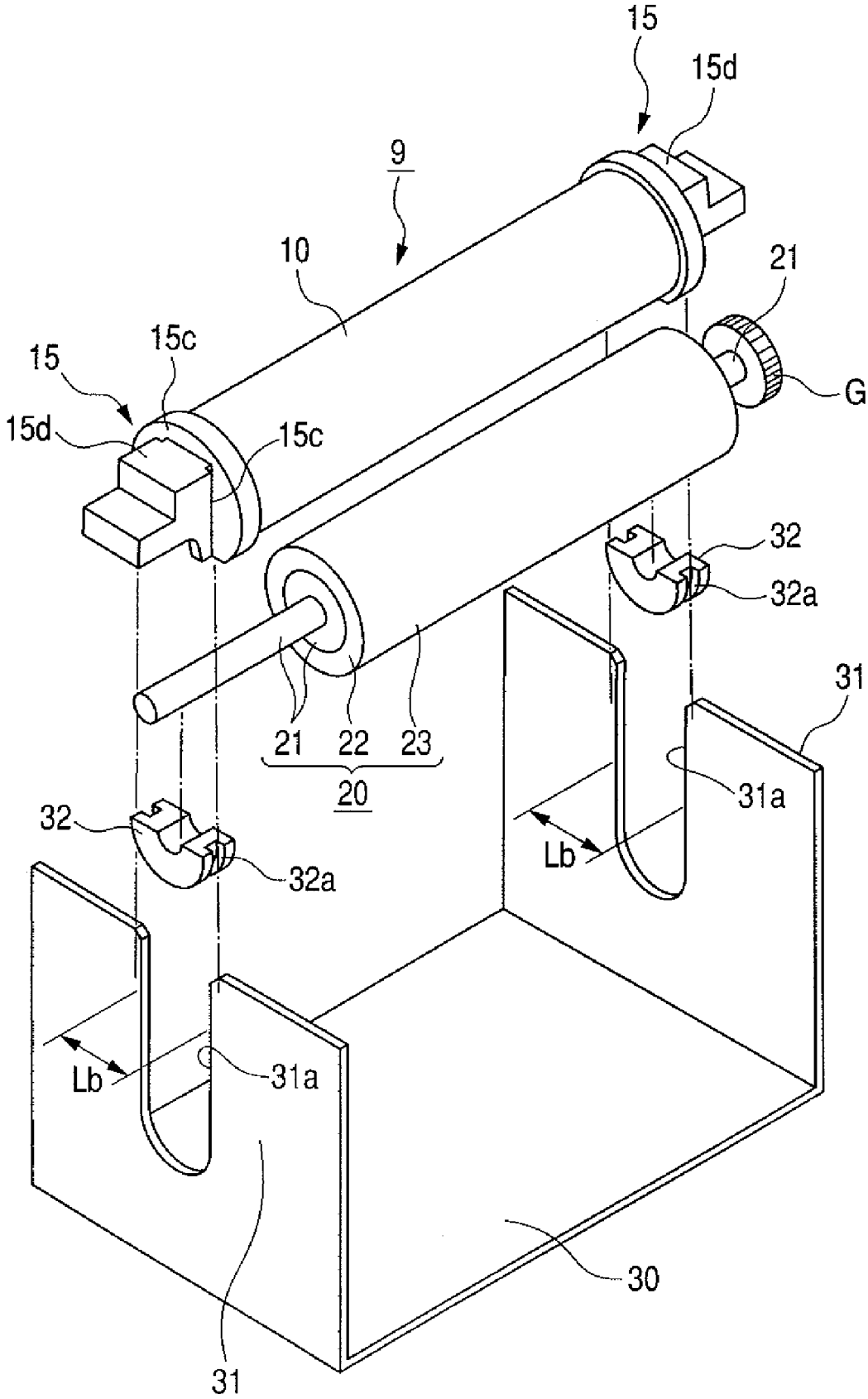
FIG. 5 is an exploded perspective model view of the fixing apparatus.
Figure 6:
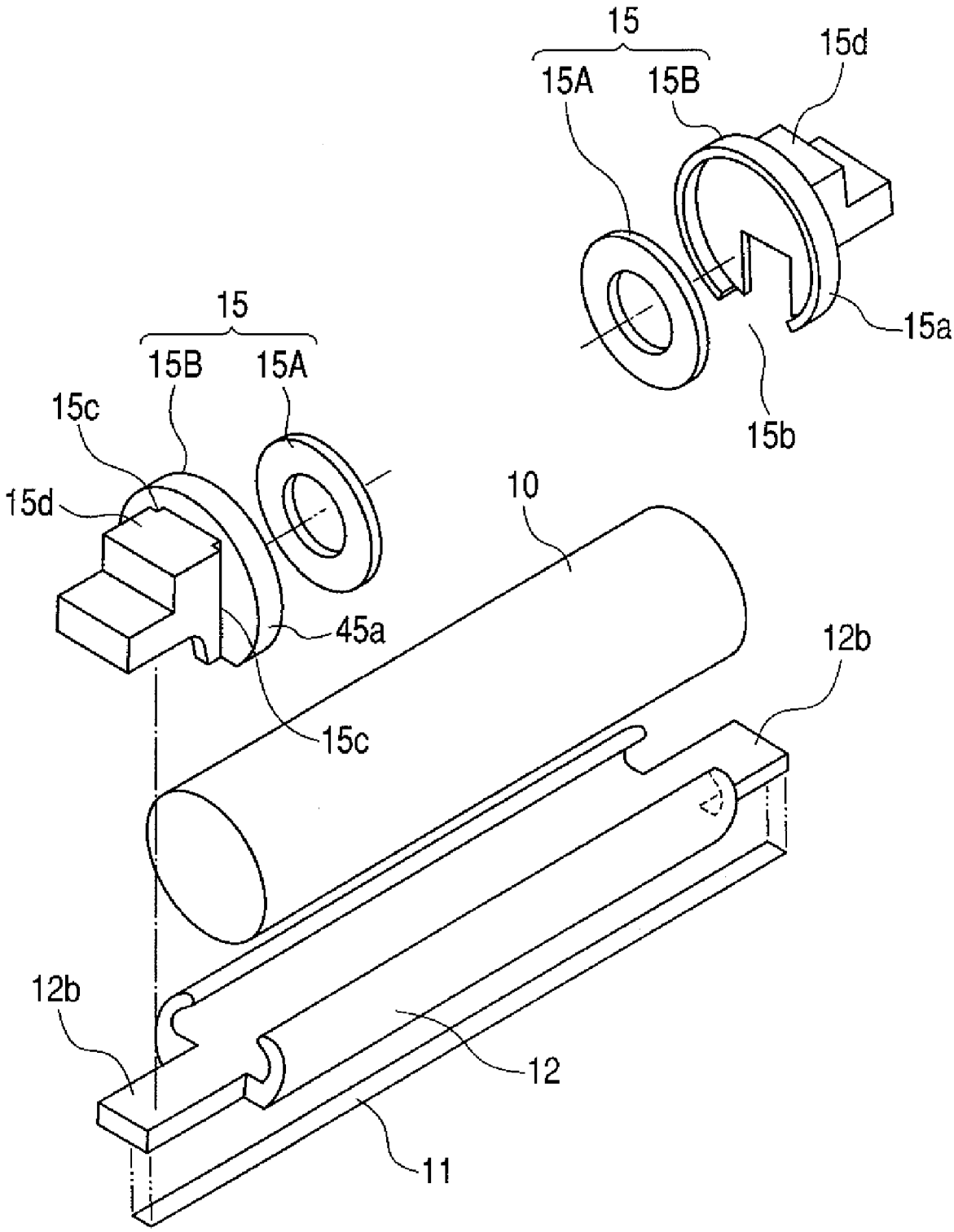
FIG. 6 is an exploded perspective model view of a heating unit.

FIG. 2 is a front model view of the fixing apparatus 6 with a portion thereof omitted, FIG. 3 is a longitudinal sectional front model view thereof, and FIG. 4 is an enlarged transverse sectional model view taken along the line 4-4 of FIG. 2. FIG. 5 is an exploded perspective model view of the apparatus, and FIG. 6 is an exploded perspective model view of a heating unit.

The reference numeral 9 denotes the heating unit. The reference numeral 20 designates an elastic pressure roller as a pressure rotary member. The heating unit 9 and the pressure roller 20 are vertically held substantially in parallel to each other between the left and right side plates 31 of an apparatus housing (metal sheet frame) 30 to thereby form a fixing nip portion N as a heating nip portion by the pressure contact between the two.

The heating unit 9 is an assembly of members mentioned under the following items a to d.

a: a sideways long adiabatic stay holder 12 having heat resistance and rigidity;

b: a heater (heating member) 11 generating heat by electrical energization and fitted in and fixedly supported by a concave groove portion 12*a* (FIG. 4) provided in the underside of the adiabatic stay holder 12 along the width direction of this member;

c: a cylindrical (endless) fixing belt 10 having flexibility as a heating member loosely fitted on the adiabatic stay holder 12 having the heater 11 fixedly supported thereby; and d: flange members 15 as regulating means mounted on the outwardly extending portions 12*b* on the left and right end sides of the adiabatic stay holder 12 for regulating the bias movement of the fixing belt 10 in the width direction (bus line direction) thereof.

The elastic pressure roller 20 as a pressure member comprises a mandrel 21 and an elastic layer 22 formed on the outside of the mandrel 21 by heat-resisting rubber such as silicon rubber or fluorine rubber or by foaming silicon rubber. A mold-releasable layer 23 of PFA, PTFE, FEP or the like may be formed on the elastic layer 22 of a width Lb.

Longitudinally long grooves 31*a* for fitting each having its upper side formed into an opening portion are formed in the same shape (bisymmetrically) in the left and right side plates 31 of the apparatus housing 30. A bearing member 32 or a bearing formed of a heat-resistant resin such as PEEK, PPS or a liquid crystal polymer is mounted with respect to the bottom portion of each groove 31*a* for fitting with the fitting portion 32*a* engaged with the latter. The left and right end portions of the mandrel 21 of the pressure roller are supported by the left and right bearing members 32 to thereby rotatably hold the pressure roller 20 between the left and right side plates 31.

As regards the heating unit 9, longitudinal fitting portions 15*c* provided on the fixed flanges (regulating members) 15B of the left and right flange portions 15 thereof which will be described later are engaged with the end portions of the grooves 31*a* for fitting of the above-mentioned left and right side plates 31, whereby the heating unit 9 is disposed above the pressure roller 20 and between the left and right side plates 31. The above-mentioned longitudinal fitting portions 15*c* and grooves 31*a* for fitting play the role of a guide for slide-guiding the heating unit 9 toward the pressure roller 20 between the left and right side plates 31.

Pressure springs 17 are compressedly provided between the pressure portions 15*d* of the left and right fixed flanges 15B and immovable spring receiving members 40, whereby the heating unit 9 is pressed against the upper surface of the pressure roller 20 with a predetermined pressure force against the elasticity of the fixing belt 10 and the elasticity of the pressure roller 20 to thereby form a fixing nip portion N of a predetermined width. In the fixing nip portion N, by the pressure of the heating unit 9 against the pressure roller 20, the fixing belt 10 is nipped between the underside of the adiabatic stay holder 12 holding the heater 11 and the upper surface of the elastic pressure roller 20, and is flexed following the underside of the adiabatic stay holder 12, and the inner surface of the fixing belt 10 comes into close contact with the underside of the adiabatic stay holder 12 and the flat underside of the heater 11.

(Driving Mechanism)

The letter G designates a drive gear secured to and disposed on one end portion of the mandrel 21 of the pressure roller 20. A rotating force is transmitted from a driving portion M to this drive gear G, and the pressure roller 20 is rotatively driven at a predetermined rotating speed in the counter-clockwise direction of arrow in FIG. 4. With this rotative driving of the pressure roller 20, a rotating force acts on the fixing belt 10 by the frictional force between the pressure roller 20 and the fixing belt 10 on the heating unit 9 side in the fixing nip portion N, and the fixing belt 10, with its inner surface sliding in close contact with the underside of the heater 11, comes to be rotated about the adiabatic stay holder 12 in a clockwise direction in FIG. 4, following the rotation of the pressure roller 20.

The fixing belt 10 is rotated while frictionally contacting with the heater 11 therein and the adiabatic stay holder 12 and therefore, it is preferable to make the frictional resistance between the heater 11 and the fixing belt 10 and between the adiabatic stay holder 12 and the fixing belt 10 small. For this purpose, a small amount of lubricant such as heat-resistant grease is interposed between surfaces of the heater 11 and the adiabatic stay holder 12. Thereby, the fixing belt 10 becomes smoothly rotatable.

The heater 11 effects the heating of the fixing nip portion N for melting and fixing the toner image T on the recording material P.

In a state in which the rotation of the fixing belt 10 by the rotation of the pressure roller 20 is effected and the supply of electric power to the heater 11 is effected, whereby the temperature of this heater 11 is raised and controlled to a predetermined temperature, the recording material P bearing the unfixed toner image T thereon is conveyed to between the fixing belt 10 and the pressure roller 20 in the fixing nip portion N along a heat-resistant fixing entrance guide 24. Then, the recording material P is nipped and conveyed by and through the fixing nip portion N, whereby the unfixed toner image T is heated and fixed by the heat of the heater 11 through the fixing belt 10. The recording material P passed through the fixing nip portion N is separated from the outer surface of the fixing belt 10 and is guided by a heat-resistant fixing and discharging guide, not shown, and is discharged onto a discharging tray, not shown.

(Fixing Belt)

The fixing belt 10 as an endless belt is a flexible sleeve of a small heat capacity. More specifically, it is a sleeve having as a base layer singly a metal member of stainless steel, Al, Ni, Cu, Zn or the like having heat resistance and high thermal conductivity, or an alloy member of these metals, and having a total thickness of 500 μm or less in order to make a quick start possible. Also, as a metallic sleeve having sufficient strength to constitute a fixing apparatus of a long life, and excellent in durability, it is preferable that the total thickness thereof be 30 μm or greater. Consequently, it is preferable that the total thickness of the fixing belt 10 be 30 μm or greater and 500 μm or less.

Further, in order to prevent offset and secure the separability of the recording material, the surface of the fixing belt is covered with one or a mixture of fluorine resins such as PTFE (polytetrafluoroethylene), PFA (tetrafluoroethylene parfluoroalkyl vinyl ether copolymer), FEP (tetrafluoroethylene hexafluoropropylene copolymer), ETFE (ethylene tetrafluoroethylene copolymer), CTFE (polychlorotrifluoroethylene) and PVDF (polyvinylidene fluoride), and a heat-resisting resin good in mold releasability such as silicone resin. The covering method may be of a type which etches the outer surface of the base material of the metallic sleeve, and thereafter applying the above-mentioned mold-releasable layer as by dipping or power spray, or a type which covers the surface of the metallic sleeve with a member formed into the shape of a tube. Or the covering method may be a method of blast-treating the outer surface of the base material of the metallic sleeve, and thereafter applying a primer layer which is an adhesive agent thereto, and covering the above-mentioned mold-releasable layer.

Also, a fluorine resin layer, a polyimide layer, a polyamideimide layer or the like which is highly lubricative may be formed on the inner surface of the metallic sleeve which contacts with the heater 11.

(Heater 11)

Figure 7:
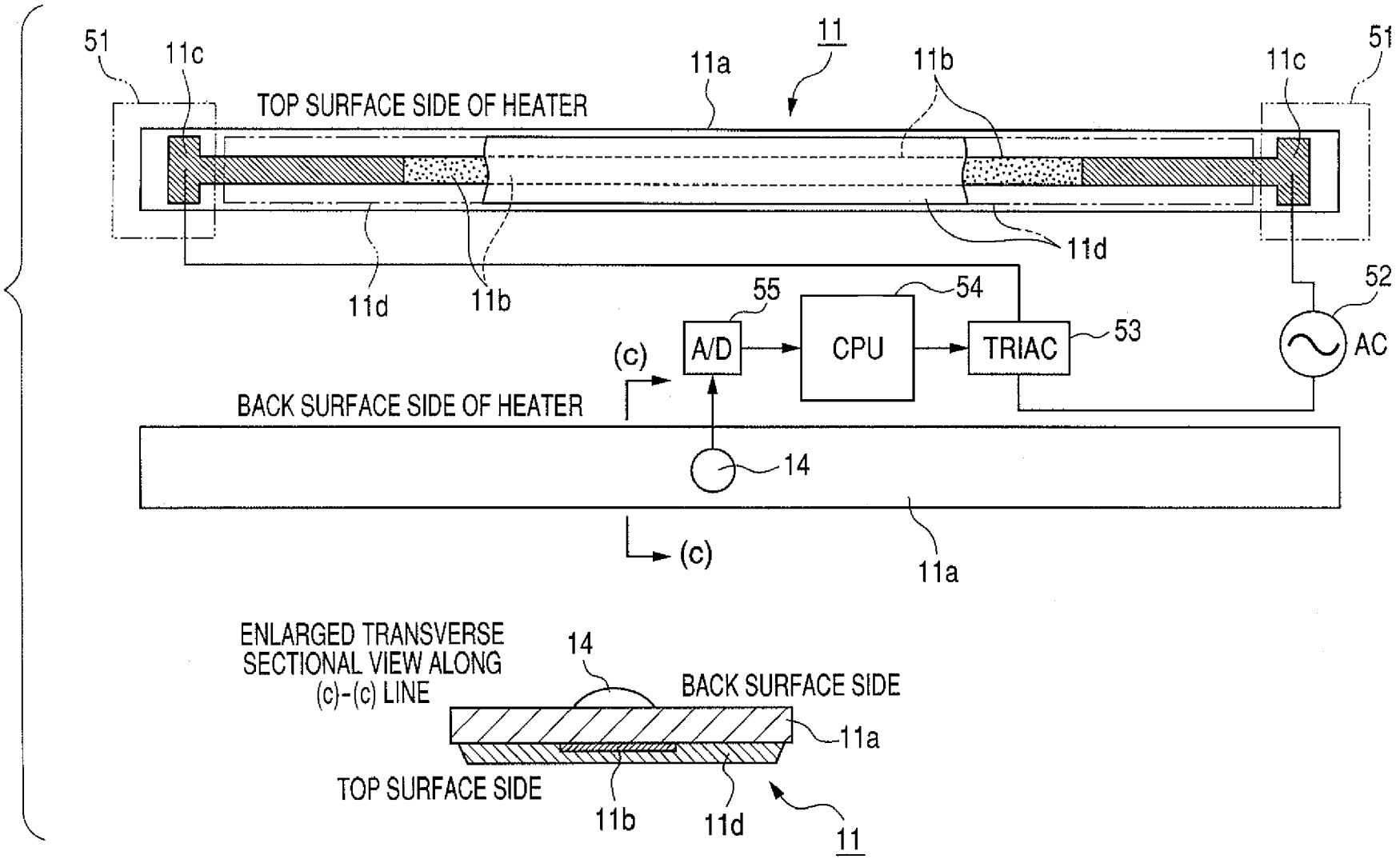
FIG. 7 schematically shows the construction of a heater (ceramic heater).

The heater 11 which effects the heating of the fixing nip portion N for melting and fixing the toner image T on the recording material P is an electrically energization heating member formed by coating, for example, the surface of a substrate of highly insulative ceramics such as AlN (aluminum nitride) or a substrate of a heat-resistant resin such as polyimide, PPS or liquid crystal polymer, along the longitudinal direction thereof, with an electrical energization heat generating resistance layer of e.g. Ag/Pd (silver palladium), $RuO_2$, $Ta_2N$ or the like into the shape of a line or a thin band having a thickness of the order of 10 μm and a width of the order of 1 to 5 mm by screen printing or the like. FIG. 7 schematically shows the construction of an example of such a heater (ceramic heater) 11. The heater 11 has the following constituents a to e.

a: a sideways long ceramic substrate (heater substrate) 11*a* formed of highly insulative ceramics such as alumina, aluminum nitride (AlN) or silicon carbide;

b: an electrical energization heat generating resistance layer 11*b* of e.g. Ag/Pd (silver palladium), $RuO_2$, $Ta_2N$ or the like formed by coating the surface side of the above-mentioned ceramic substrate 11*a* along the length (width direction thereof) into the shape of a line or a thin band having a thickness of the order of 10 μm and a width of the order of 1 to 5 mm by screen printing or the like, and sintering the coating;

c: electrode portions 11*c* formed of Ag/Pt (silver platinum) and provided on the longitudinally opposite end portions of the above-mentioned electrical energization heat generating resistance layer 11*b* by electrical conduction;

d: an insulating protective layer 11*d* such as a thin-layer glass coat or fluorine resin coat provided on the surface of the electrical energization heat generating resistance layer 11*b*, and electrically insulating and capable of standing the frictional contact with the metallic fixing belt 10; and e: a temperature detecting element 14 such as a thermistor provided on the back surface (rear surface) side of the ceramic substrate 11*a*.

In the heater 11, that side thereof on which the insulating protective layer 11*d* is provided is the top surface side, and the fixing belt 10 slides on the surface of the insulating protective layer 11*d*. This heater 11 is fitted into the concave groove portion 12*a* (FIG. 4) provided in the underside of the adiabatic stay holder 12 along the length of this member, and is secured thereto by a heat-resistant adhesive agent and is held thereby.

The reference numeral 51 designates electric power supplying connectors fitted to the electrode portions 11*c* of the heater 11 fixedly supported by the adiabatic stay holder 12, and the electrical contacts of the electric power supplying connectors come into contact with the electrode portions 11*c*. The reference numeral 52 denotes a commercially available power source (AC), the reference numeral 53 designates a triac, and the reference numeral 54 denotes electric power (electric power supply) controlling means (CPU) (AC line). The heater H is supplied with electric power between the electrode portions 11*c* from the commercially available power source 52 through the triac 53, whereby it quickly and sharply rises in temperature by the heat generation of the electrical energization heat generating resistance layer 11*b*.

The temperature rise of the heater 11 is detected by the temperature detecting element 14 which is a temperature detecting member, and the electrical analog information of the detected temperature is inputted to an analog/digital converting circuit (A/D converting circuit) 55, and is digitized thereby and is inputted to the electric power controlling means 54. The DC power supply from the temperature detecting element 14 to the temperature controlling portion is accomplished by a connector, not shown, through a DC power supplying portion and a DC electrode portion, not shown.

The duty ratio, wave number, etc. of a voltage applied from the electrode portions 11*c* on the longitudinally opposite end portions of the heater 11 to the electrical energization heat generating resistance layer 11*b* are appropriately controlled in conformity with the signal of the temperature detecting element 14, to thereby effect heating necessary to keep the controlled temperature in the fixing nip portion N substantially constant, and fix the toner image T on the recording material P. That is, the electric power controlling means 54 to which the digital information conforming to the detected temperature by the temperature detecting element 14 is inputted is adapted to control the supply of electric power from the commercially available power source 52 to the electrical energization heat generating resistance layer 11*b* so that the detected temperature by the temperature detecting element 14 may assume a value within a predetermined range from a target temperature.

As the control of the supply of electric power from the commercially available power source 52 to the electrical energization heat generating resistance layer 11*b* by the electric power controlling means 54, there is adopted the phase control of changing a phase range used for the supply of electric power from the commercially available power source 52 to the electrical energization heat generating resistance layer 11*b* at each half wave cycle of an AC power supply outputted from the commercially available power source 52, in conformity with the detected temperature by the temperature detecting element 14, or the wave number control of changing over the supply of electric power from the commercially available power source 52 to the electrical energization heat generating resistance layer 11*b* to conduction or cutoff at each half wave cycle previously mentioned, in conformity with the detected temperature by the temperature detecting element 14.

When AlN or the like which is excellent in wear resistance and good in thermal conductivity is used as the heater substrate 11*a*, the electrical energization heat generating resistance layer 11*b* may be formed on a side opposite to the fixing nip portion N with respect to the above-mentioned substrate.

(Adiabatic Stay Holder)

The adiabatic stay holder 12 is a rigid, heat-resistant and adiabatic member playing the role of supporting the heater 11, the role of a rotation guide member for the fixing belt 10, the role of a pressure member, the role of an adiabatic member for preventing the radiation in a direction opposite to the fixing nip portion N, etc., and is formed of a liquid crystal polymer, a phenol resin, PPS, PEEK or the like.

In the present embodiment, that portion of the adiabatic stay holder 12 which is downstream of the fixing nip portion N is protruded to the pressure roller 20 side to thereby provide a convexly shaped portion K (in FIG. 4, a jaw portion for changing the curvature of the fixing belt) having a height of 1.0 mm. This is for changing the rotation shape of the fixing belt 10 by the convexly shaped portion K, and curvature-separating the recording material P and the fixing belt 10 from each other.

(Flange Members)

The flange members 15 as regulating means mounted on the left and right end portions of the adiabatic stay holder 12 for regulating the bias movement, in the width direction, of the fixing belt 10 which is an endless belt for heating the image on the recording material in the nip portion have ring-shaped or disk-shaped first regulating members (hereinafter referred to as the driven rings (sliding flanges)) 15A as flat plate-shaped rotary members (plate-shaped members) provided at a predetermined distance from the fixing belt 10 and capable of being driven to rotate by striking against the end surface of the fixing belt 10 with the bias of the fixing belt 10. The flange members 15 further have second regulating members (hereinafter referred to as the fixed flanges) 15B which are fixed members fixed substantially against rotation for regulating the movement of the driven rings 15A in the width direction by the fixing belt 10.

Figure 8:
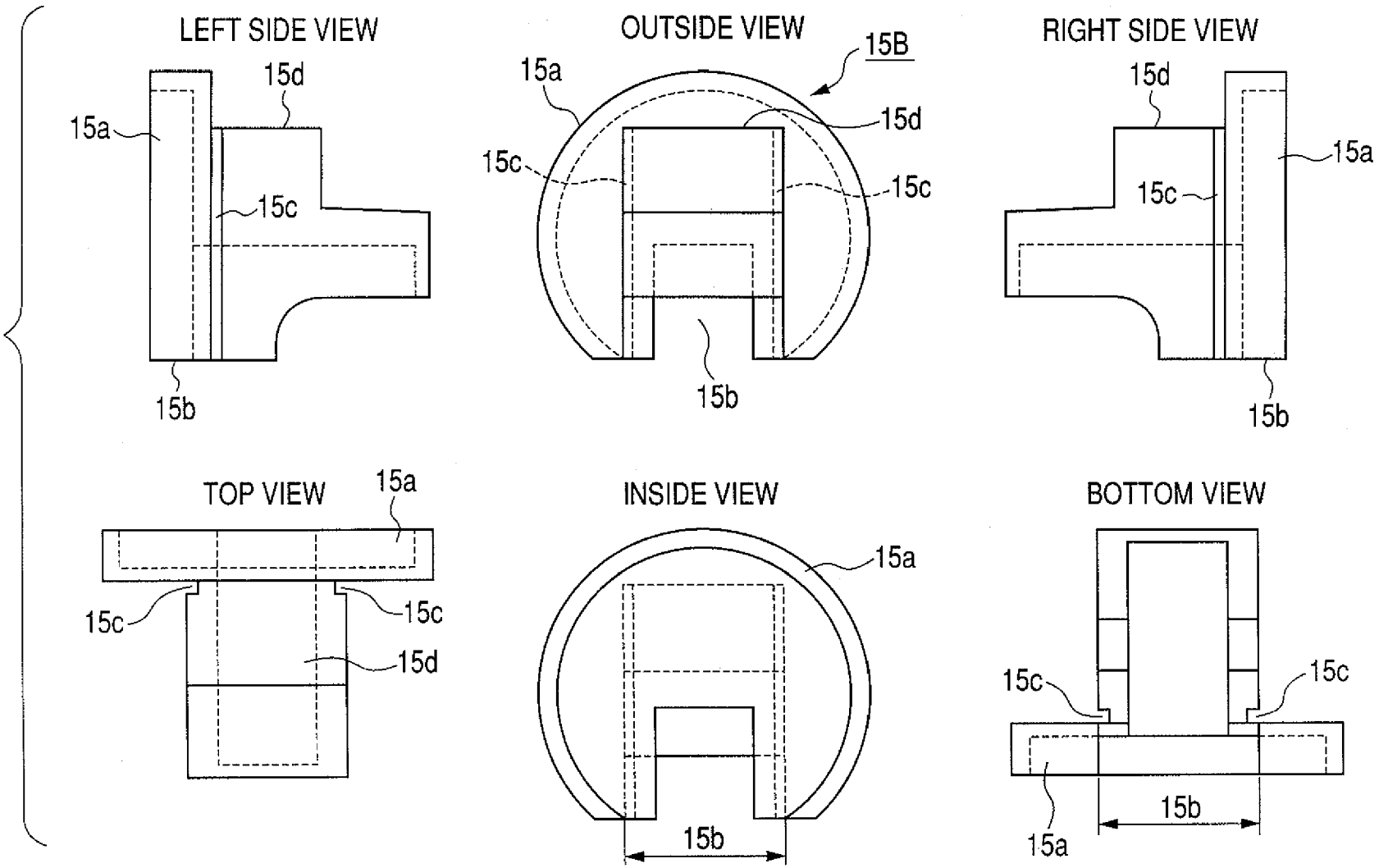
FIG. 8 includes six views showing the shape of a fixed flange.
Figure 9:
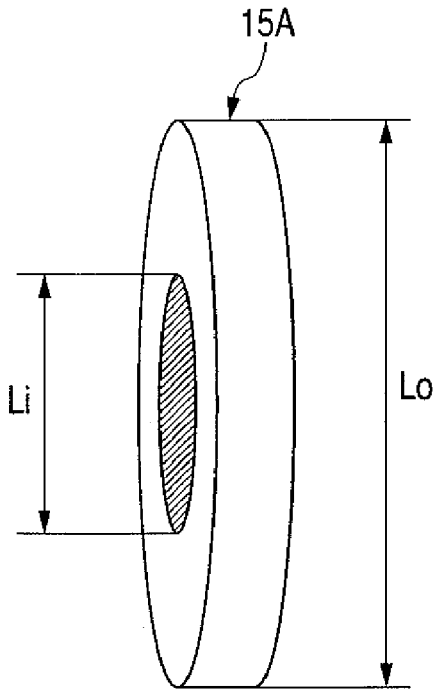
FIG. 9 is a perspective view of a driven ring.
Figure 10:
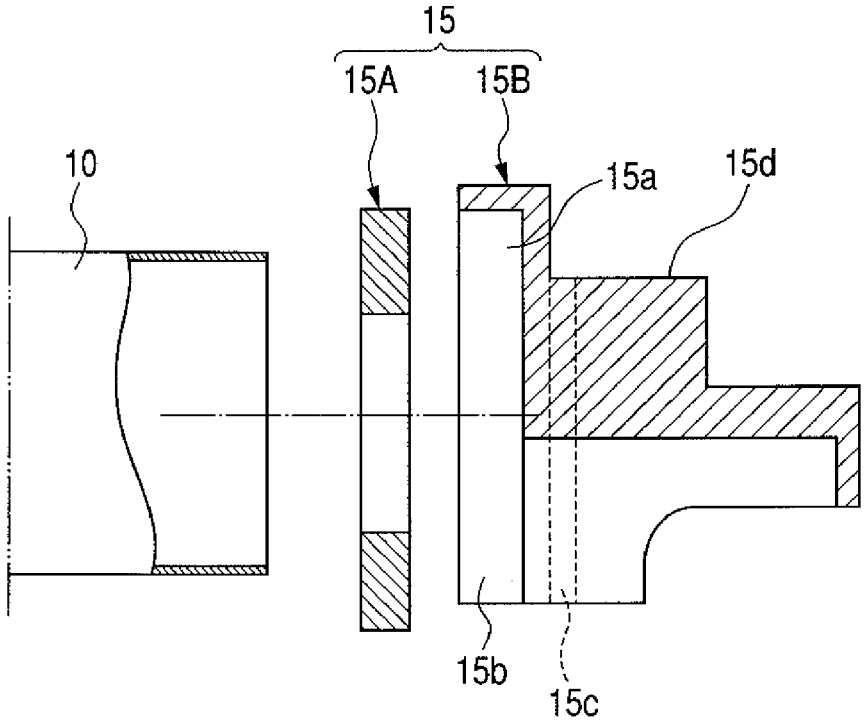
FIG. 10 is a cross-sectional view of the fixed flange and the driven ring.

FIG. 8 include six views (an outside view, an inside view, a left side view, a right side view, a top plan view and a bottom plan view) showing the shape of the fixed flange 15B, FIG. 9 is a perspective view of the driven ring 15A, and FIG. 10 is a cross-sectional view of the fixed flange 15B and the driven ring 15A.

(Fixed Flange)

The fixed flange 15B as the second regulating member is formed of a heat-resisting resin such as PPS, liquid crystal polymer or phenol resin, and is of a cap shape, and has on the inner surface side thereof an insertion portion 15*a* having an inner diameter into which the driven ring 15A as the first regulating member is insertable. Also, this inner diameter has a sufficiently large size so that as shown in FIG. 4, the outer peripheral surface of the fixing belt 10 may not contact with the inner peripheral surface of the insertion portion 15*a* even when the outer peripheral shape of the fixing belt 10 is deformed by making the nip.

The fixed flange 15B as the regulating member for the driven ring 15A regulates the driven ring 15A in the width direction thereof and also, regulates the rotational position of the driven ring 15A.

The fixed flanges 15B are fitted to the outward extensions 12*b* of the left and right opposite end portions of the adiabatic stay holder 12, and the longitudinal fitting portions 15*c* of the fixed flanges 15B are engaged with the fitting grooves 31*a* of the side plates 31 of the apparatus housing 30 to thereby mount the fixed flanges on the side plates 31. Thus, the fixed flanges 15B regulate the movement of the driven rings 15A in the longitudinal direction thereof.

Also, a portion of the insertion portion 15*a* is cut away as indicated by 15*b* so as not to interfere with the heater 11, and the width of the cut-away portion 15*b* is made smaller than the outer diameter of the driven ring 15A. Thereby, the rotational position of the driven ring 15A in the insertion portion 15*a* is regulated. That is, by the fixing nip portion side of the insertion portion 15*a* being cut away, the insertion portion 15*a* and the fixing nip area can be made to overlap each other in the longitudinal direction of the fixing nip portion.

(Driven Ring)

The driven ring 15A as the first regulating member is formed of a heat-resisting resin such as PPS, a liquid crystal polymer or phenol resin.

The shape of the driven ring 15A, as shown in FIGS. 9 and 10, is a ring-shaped disk, and the outer diameter Lo thereof is smaller than the inner diameter of the insertion portion 15*a* of the fixed flange 15 and larger than the cut-away portion 15*b*. Also, the inner diameter Li thereof is of such a size as does not interfere with the heater 11. The outward extension 12*b* of the adiabatic stay holder 12 is located in and through this inner diameter Li, and the driven ring 15A and the outward extension 12*b* of the adiabatic stay holder 12 do not interfere with each other.

As described above, the driven ring is made into a flat plate shape so as not to frictionally slide with the outer surface of the end portion of the belt. That is, the driven ring is made into a shape free of a brim like that of the conventional protective cap described above.

This endless ring-shaped or disk-shaped driven ring 15A as the first regulating member is flat only on its surface opposed to the endend portion of the fixing belt 10 which is a rotary member in the bus line direction thereof.

The driven ring 15A regulates the endend portion of the fixing belt 10 in the width direction thereof, and the fixing belt 10 is biased by receiving a force in the width direction and strikes against the driven ring 15A and at the same time, the driven ring 15A receives a driving force from the fixing belt 10 and is rotated with the fixing belt 10 to thereby prevent the endend portion of the fixing belt 10 from frictionally sliding, and does not restrict the rotation shape of the fixing belt 10 and therefore, does not give any load to the fixing belt 10 and prevents the end portion of the fixing belt 10 from being damaged.

Also, on the end portion opposite to the bias direction, the fixing belt 10 does not contact with the driven ring 15A and therefore, the driven ring 15A is not rotated, but yet it is of a flat shape and therefore has no portion which frictionally contacts with the outer surface of the end portion of the fixing belt 10 and thus, does not injure the outer surface of the end portion of the fixing belt 10. Accordingly, the durability of the belt 10 can be improved. Also, the construction of the present embodiment can be sufficiently mounted even if the speed of the image forming process (fixing process) is made higher.

Also, in the present embodiment, the coefficient of friction $\mu 1$ of the fixing belt 10 and the driven ring 15A and the coefficient of friction $\mu 2$ of the driven ring 15A and the fixed flange 15B are set so as to be ($\mu 1 > \mu 2$). Thereby, the driven ring 15A is adapted to reliably follow the fixing belt 10 when the fixing belt 10 is bias-moved and the end of the belt strikes against the driven ring 15A.

As described above, the regulating means 15 for regulating the bias of the fixing belt 10 in the width direction thereof has the driven ring 15A which is a flat plate-shaped rotary member provided at a predetermined distance from the fixing belt 10 and striking against the end surface of the fixing belt 10 with the bias of the fixing belt 10 to thereby be capable of being driven to rotate. As the result, it does not restrict the configuration of the fixing belt 10 and therefore, even if the curvature of the rotation shape of the fixing belt 10 is greatly changed, that portion does not receive any load from the driven ring 15A and thus, the damaging of the fixing belt 10 is not caused. Also, it has no portion contacting with the surface of the fixing belt and therefore does not injure the surface layer of the fixing belt, and does not cause the peeling of the surface layer. Also, only when the fixing belt 10 is biased and the end portion of the fixing belt strikes against the driven ring 15A, a driving force is transmitted from the fixing belt to the driven ring 15A, which in turn follows the fixing belt 10 and does not cause the damaging of the end portion.

Also, the coefficient of friction $\mu 1$ of the fixing belt 10 and the driven ring 15A and the coefficient of friction $\mu 2$ of the driven ring 15A and the fixed flange 15B are set so as to be ($\mu 1 > \mu 2$), whereby when the fixing belt 10 is biased by receiving a biasing force and strikes against the driven ring 15A, the driven ring 15A follows the fixing belt 10, and the driven ring 15A and the fixed flange 15B slide. By the driven ring 15A following the fixing belt 10, the load due to the sliding is not applied to the end portion of the fixing belt 10 in the bus line direction thereof and therefore, the damaging of the fixing belt 10 is not caused.

On the end portion opposite to the bias direction of the fixing belt 10, the fixing belt 10 is not in contact with the driven ring 15A and therefore, the driven ring 15A does not follow the fixing belt 10, but yet the driven ring 15A is flat and therefore, does not contact with the surface layer of the fixing belt and thus, does not cause the shaving of the surface layer of the fixing belt.

As described above, even when use is made of a belt having a metal layer, the bias of the belt can be properly regulated without the damaging of the end portion of the belt being caused, irrespective of the shape of the fixing nip.

(Modifications)

1) There can also be adopted an apparatus construction in which the direction of bias movement of the fixing belt 10 is made single, and the flange member 15 (15A+15B) for regulating the end portion of the fixing belt 10 is disposed only on one end portion side of the direction of bias movement.

2) The heater 11 can be an exciting coil generating a magnetic flux for electromagnetically inducing an object to be heated to generate heat by the action of a magnetic field generated by an exciting coil assembly. In this case, it is preferable to provide an electrically conducting layer on the fixing belt 10 which is the object to be heated.

3) It is possible to adopt a fixing apparatus using a belt instead of the above-described pressure roller.

4) Examples of the application of the image heating apparatus are not restricted to the fixing apparatus, but can be, for example, an apparatus for heating a fixed image on a recording material to thereby improve a surface property such as gloss, and an apparatus for tentatively fixing an unfixed toner image.

The present invention is not restricted to the above-described embodiments, but can of course be changed to various constructions and other known constructions within the scope of the technical idea of the present invention.

This application claims priority from Japanese Patent Application No. 2005-011712 filed Jan. 19, 2005, which is hereby incorporated by reference herein.

What is claimed is:

1. An image heating apparatus comprising:

an endless belt for heating an image on a recording material in a nip portion, said endless belt having an outer peripheral surface that faces the image on the recording material;

a nip forming means for forming said nip portion between itself and said belt; and a regulating means for regulating movement of said belt in a width direction thereof, said regulating means having a plate-shaped member rotatable by the contact thereof with an end surface of said endless belt that faces perpendicular to said outer periphelar surface;

wherein said endless belt rotates without said outer peripheral surface of said endless belt contacting with said regulating device.

2. An image heating apparatus according to claim 1, wherein said regulating means has a substantially unrotatably provided regulating member for regulating the movement of said plate-shaped member in said width direction.

3. An image heating apparatus according to claim 2, wherein when the coefficient of friction of said belt and said plate-shaped member is defined as $\mu 1$, and the coefficient of friction of said plate-shaped member and said regulating member is defined as $\mu 2$, $\mu 1 > \mu 2$ is realized.

4. An image heating apparatus according to claim 1, wherein said belt has a metal layer, and the total thickness of said belt is 30 μm or greater and 500 μm or less.

* * * * *